US010247368B2

(12) United States Patent
Park et al.

(10) Patent No.: US 10,247,368 B2
(45) Date of Patent: Apr. 2, 2019

(54) LIGHTING DEVICE FOR VEHICLE

(71) Applicant: LG ELECTRONICS INC., Seoul (KR)

(72) Inventors: Soyeon Park, Seoul (KR); Sangok Yeo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/622,501

(22) Filed: Jun. 14, 2017

(65) Prior Publication Data

US 2017/0356617 A1 Dec. 14, 2017

(30) Foreign Application Priority Data

Jun. 14, 2016 (KR) ..... 10-2016-0074103

(51) Int. Cl.

| | |
|---|---|
| ***F21K 9/64*** | (2016.01) |
| ***F21S 41/32*** | (2018.01) |
| ***F21S 41/14*** | (2018.01) |
| ***F21S 41/20*** | (2018.01) |
| ***F21S 45/47*** | (2018.01) |

(Continued)

(52) U.S. Cl.

CPC ..... *F21K 9/64* (2016.08); *F21S 41/14* (2018.01); *F21S 41/16* (2018.01); *F21S 41/285* (2018.01); *F21S 41/32* (2018.01); *F21S 41/322* (2018.01); *F21S 45/47* (2018.01); *F21S 41/365* (2018.01); *F21Y 2115/30* (2016.08)

(58) Field of Classification Search

None

See application file for complete search history.

(56) References Cited

U.S. PATENT DOCUMENTS 8,882,284 B2 * 11/2014 Tong ..... F21V 9/30 362/84
2010/0165653 A1 * 7/2010 Ookubo ..... F21V 13/02 362/539
2013/0314937 A1 11/2013 Takahashi et al.

FOREIGN PATENT DOCUMENTS

DE 102012209172 12/2013
DE 102012211915 1/2014

(Continued)

OTHER PUBLICATIONS

Notice of Allowance in Korean Application No. 10-2016-0074103, dated Sep. 8, 2017, 7 pages (with English translation).

(Continued)

*Primary Examiner* — Sharon E Payne
(74) *Attorney, Agent, or Firm* — Fish & Richardson P.C.

(57) ABSTRACT

A lighting device for a vehicle includes a light source device; a main lens; a reflective fluorescent body configured to reflect and convert wavelengths of incident beams; and a prism arranged between the main lens and the reflective fluorescent body. The prism is configured to: reflect beams emitted from the light source device to be incident on the reflective fluorescent body; and transmit, through the prism and to the main lens, beams reflected from the reflective fluorescent body. The prism includes: a first surface facing the reflective fluorescent body; a second surface through which beams are incident; and a third surface forming an acute angle with the first surface. The prism is configured such that the beams incident through the second surface of the prism form angles of incidence, with respect to the third surface of the prism, that are greater than a critical angle of the prism.

20 Claims, 5 Drawing Sheets

(51) Int. Cl.

| | |
|---|---|
| ***F21S 41/16*** | (2018.01) |
| *F21Y 115/30* | (2016.01) |
| *F21S 41/365* | (2018.01) |

(56) References Cited

FOREIGN PATENT DOCUMENTS

| | | |
|---|---|---|
| DE | 102013110272 | 3/2015 |
| EP | 3228926 | 10/2017 |
| JP | 2014178464 | 9/2014 |
| JP | 2015184303 | 10/2015 |
| KR | 10-2011-0022720 | 3/2011 |

OTHER PUBLICATIONS

Office Action in Korean Application No. 10-2016-0074103, dated Apr. 19, 2017, 9 pages (with English translation).
European Search Report in European Application No. 17172733.2, dated Nov. 8, 2017, 8 pages (with English translation).

* cited by examiner

LIGHTING DEVICE FOR VEHICLE

CROSS-REFERENCE TO RELATED APPLICATIONS

The present application claims the benefit of an earlier filing date and right of priority under 35 U.S.C. § 119(a) and 35 U.S.C. § 365(b) to Korean Patent Application No. 10-2016-0074103 filed on Jun. 14, 2016, the contents of which are hereby incorporated by reference in its entirety.

TECHNICAL FIELD

The present disclosure relates to a lighting device for a vehicle.

BACKGROUND

A lighting device such as a lamp is typically installed in a vehicle. A lighting device typically assists a driver by improving the driver's visibility by increasing an illumination intensity around the vehicle, or notifies people outside the vehicle of a current traveling state of the vehicle.

Lighting devices installed in vehicles typically include a head lamp for irradiating beams to the front of the vehicle, and a rear lamp at the rear of the vehicle for indicating a movement direction of the vehicle or indicating whether a brake of the vehicle is actuated.

A lighting device typically forms low beams or high beams so as to ensure a driver's visibility, for example when the vehicle travels at night. Examples of such lighting devices include light emission diodes (LEDs) having high power efficiency and long lifespan, and laser diodes having a long irradiation distance.

SUMMARY

Implementations described herein provide a lighting device for a vehicle that is configured to perform wavelength conversion and redirection of beams that are emitted to an outside of the vehicle.

In one aspect, a lighting device for a vehicle may include a light source device; a main lens; a reflective fluorescent body configured to reflect and convert wavelengths of incident beams; and a prism arranged between the main lens and the reflective fluorescent body. The prism may be configured to: reflect beams emitted from the light source device to be incident on the reflective fluorescent body; and transmit, through the prism and to the main lens, beams reflected from the reflective fluorescent body. The prism may include a first surface facing the reflective fluorescent body; a second surface through which beams are incident; and a third surface forming an acute angle with the first surface. The prism may be configured such that the beams incident through the second surface of the prism form angles of incidence, with respect to the third surface of the prism, that are greater than a critical angle of the prism.

In some implementations, the light source device may include a light source and a condensing member configured to condense beams emitted from the light source.

In some implementations, the condensing member may include an auxiliary lens configured to condense beams.

In some implementations, the light source device may further include a reflecting member configured to redirect paths of beams emitted from the condensing member of the light source device to be incident into the prism.

In some implementations, the light source of the light source device may be configured to emit beams in a direction parallel to an optical axis of the main lens.

In some implementations, the reflective fluorescent body may be disposed on an optical axis of the main lens.

In some implementations, prism may be configured such that the second surface of the prism is formed at a right angle relative to a direction in which beams are incident into the prism.

In some implementations, the prism may be configured such that the second surface of the prism forms a right angle with the first surface of the prism.

In some implementations, the prism may be arranged such that the first surface of the prism is spaced apart from the reflective fluorescent body.

In some implementations, the prism and the main lens may be arranged such that the prism contacts the main lens.

In some implementations, the prism may further include a fourth surface extending between the third surface and the second surface. The reflective fluorescent body and the prism may be arranged such that angles of incidence of the beams reflected by the reflective fluorescent body into the prism with respect to the fourth surface are smaller than the critical angle of the prism.

In some implementations, the prism may be configured such that: the fourth surface of the prism is parallel to the first surface of the prism, and a horizontal length of the fourth surface of the prism is smaller than a horizontal length of the first surface of the prism.

In some implementations, the third surface of the prism may include: a reflection region in which beams are reflected by the third surface to the reflective fluorescent body; and a first transmission region in which the beams reflected by the reflective fluorescent body are transmitted through the third surface. The fourth surface of the prism may include a second transmission region in which the beams reflected by the reflective fluorescent body are transmitted through the fourth surface. The reflection region of the third surface of the prism may be arranged along an outer surface of the prism between the first transmission region of the third surface and the second transmission region of the fourth surface.

In some implementations, the third surface of the prism may include a reflection region in which beams are reflected by the third surface to the reflective fluorescent body; and a first transmission region in which beams reflected by the reflective fluorescent body are transmitted through the third surface. The fourth surface of the prism may include a second transmission region in which the beams reflected by the reflective fluorescent body are transmitted through the fourth surface. The third surface may be configured such that at least a portion of the reflection region of the third surface overlaps with at least a portion of the first transmission region of the third surface.

In some implementations, the reflection region of the third surface may have a size that is smaller than a size of the first transmission region of the third surface and smaller than a size of the second transmission region of the fourth surface.

In some implementations, the third surface of the prism may include a reflection surface configured to reflect beams to the reflective fluorescent body; and a transmission surface forming a smaller inclination angle than the reflection surface, the transmission surface configured to transmit therethrough the beams that are reflected by the reflective fluorescent body.

In some implementations, the third surface of the prism may include a reflection surface configured to reflect beams to the reflective fluorescent body; and a transmission surface extending from the reflection surface and parallel to the first surface of the prism.

In some implementations, the prism and the main lens may be configured such that a size of the prism is smaller than a size of the main lens.

In some implementations, the prism may be configured such that the beams incident through the second surface and having angles of incidence, with respect to the third surface, exceeding the critical angle of the prism undergo total internal reflection at the third surface and are reflected to the reflective fluorescent body.

In some implementations, the critical angle of the prism may be a threshold angle of incidence on a surface of the prism greater than which total internal reflection occurs.

The details of one or more implementations are set forth in the accompanying drawings and the description below. Other features will be apparent from the description and drawings, and from the claims.

DETAILED DESCRIPTION

Implementations are described herein that provide a lighting device for a vehicle that includes a prism configured with reflective and transmissive properties to efficiently direct light within the lighting device while maintaining a compact size. In some implementations, the prism may be configured to reflect light from an internal surface of the prism by internal reflection, so that a separate reflecting component need not be provided in the lighting device. Accordingly, the number of optical components in the lighting device may be decreased, providing a more compact overall size.

In some implementations, the lighting device may also include a component, such as a reflective fluorescent body, that performs wavelength conversion on light before the wavelength-converted light is emitted to an outside of the vehicle. In such scenarios, a prism may be configured to redirect light from a light source to the reflective fluorescent body and also to transmit wavelength-converted light from the reflective fluorescent body to an outside of the vehicle.

Figure 1:
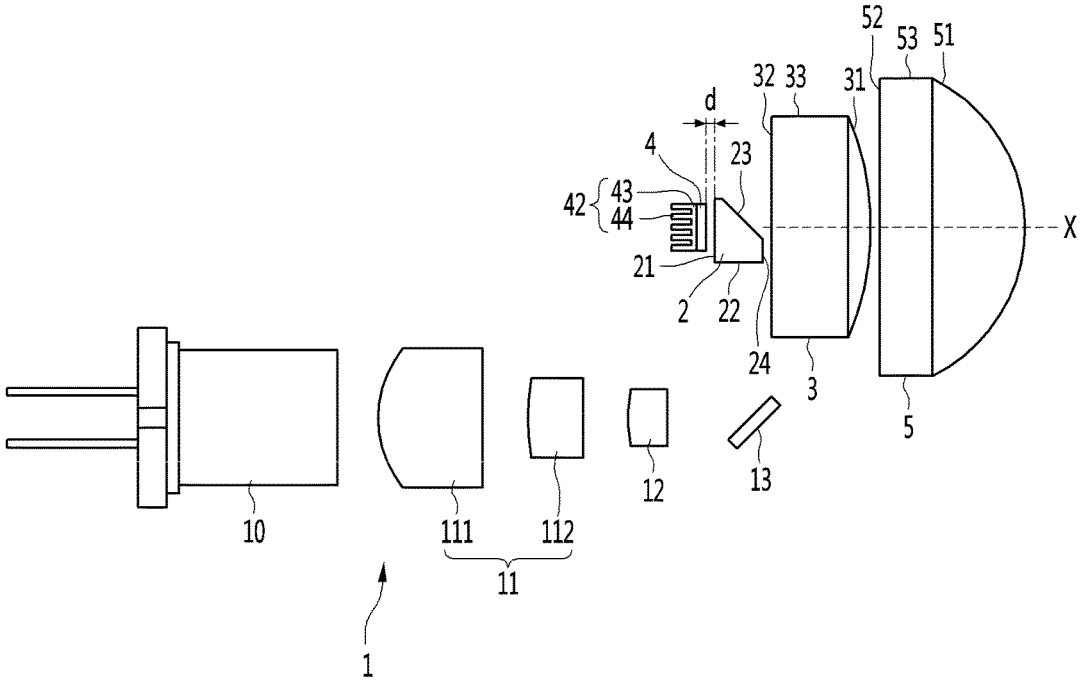
FIG. 1 is a diagram illustrating an example of a configuration of a lighting device for a vehicle.
Figure 2:
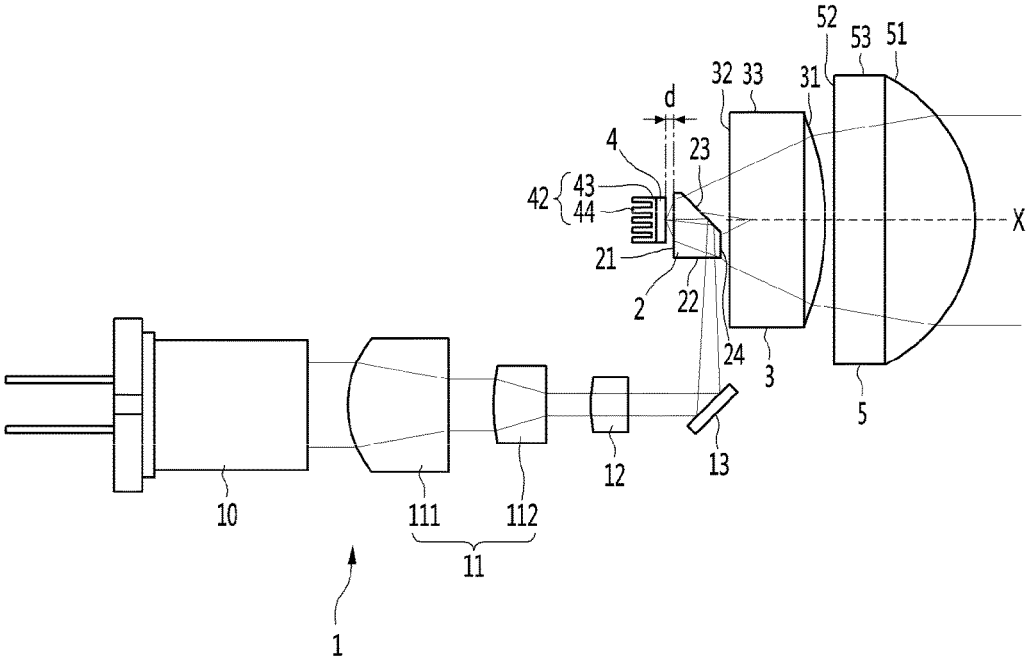
FIG. 2 is a diagram illustrating an example of a configuration and beam path of a lighting device.

FIG. 1 is a view showing a configuration of a lighting device for a vehicle according to an implementation. FIG. 2 is a view showing the configuration and beam path of the lighting device according to the implementation.

The lighting device of FIGS. 1 and 2 may, for example, constitute a head lamp of a vehicle. The lighting device may be used as a high beam lighting device for generating high beams or may be used as a low beam lighting device for generating low beams.

According to the implementation shown in FIG. 1, a lighting device mounted in a vehicle may include a light source device 1, a prism 2, a reflective fluorescent body 4, a main lens 3, and a projection lens 5 that emits light to the outside of the vehicle. In some scenarios, the prism 2 may be located between the main lens 3 and the reflective fluorescent body 4.

The prism 2 may include various surfaces that are configured and angled to provide particular reflective and transmissive properties. For example, as shown in FIGS. 1 and 2, the prism 2 may include a first surface 21 facing the reflective fluorescent body 4, a second surface 22 into which beams are incident from the light source device 1, and a third surface 23 formed at an acute angle with the first surface 21. In some implementations, the prism 2 may further include a fourth surface 24 connecting the third surface 23 and the second surface 22.

According to the implementation of FIGS. 1 and 2, the light source device 1 may emit beams toward the prism 2 such that the beams are incident on the second surface 22 of the prism 2. The beams incident on the second surface 22 may be transmitted through the second surface 22 and may be reflected by the third surface 23 to be directed to the reflective fluorescent body 4 disposed at a rear of the prism 2. In particular, the third surface 23 may be angled such that beams passing through second surface 22 and incident upon third surface 23 are reflected by third surface 23 rather than being transmitted through third surface 23.

The reflective fluorescent body 4 may receive beams reflected by the third surface 23 of prism 2, and may convert the wavelengths of those beams. The reflective fluorescent surface 4 may then reflect the wavelength-converted beams back to the first surface 21 of the prism 2.

The wavelength-converted beams may then pass through the first surface 21 and through the third surface 23 of the prism 2 to be incident on the rear surface 32 of main lens 3. The wavelength-converted beams may be condensed while being transmitted through the main lens 3, and may be transmitted through the front surface 31 of the main lens 3 and incident into the rear surface 52 of projection lens 5. The wavelength-converted beams may be condensed through the projection lens 5 to be emitted in parallel to each other, and may be irradiated to the front of the vehicle.

As such, the above-described configuration of prism 2 provides reflective and transmissive properties to appropriately direct light to and from the reflective fluorescent body 4 while maintaining a shortened length of the prism 2, so that the overall size of the lighting device may be compact.

As described above, beams are redirected by the total reflective property of third surface 23 inside prism 2, and therefore, a separate reflecting part need not be provided. Accordingly, the number of optical components in the lighting device may be decreased, providing a more compact lighting device.

Further details of examples of components of the lighting device are described next, still with reference to FIGS. 1 and 2.

The light source device 1 may be disposed at the rear of the main lens 3.

The light source device 1 may include a light source 10 configured to emit light beams and a condensing member 12 for condensing the beams emitted from the light source 10. Preferably, the light source device 1 may further include a beam reducer 11 for allowing incident beams to be emitted by reducing the beam widths of the incident beams, and a reflecting member 13 for allowing beams to be incident into the prism 2 by changing the beam paths of the beams.

In some implementations, the light source 10 may be supplied with electrical energy to convert the electrical energy into optical energy. The light source 10 may be a lighting source such as, for example, an ultra-high pressure mercury-vapor lamp (UHV Lamp), a light emission diode (LED), or a laser diode (LD).

Preferably, the light source 10 has excellent linearity and high efficiency, and enables long-distance irradiation. In some implementations, the light source 10 is preferably a laser diode. If a laser diode is implemented as the light source 10, the laser diode may preferably irradiate blue-based laser beams having high efficiency.

In some implementations, the lighting device may include a heat dissipation member for dissipating heat generated from the light source 10. The heat dissipation member may, for example, include a contact plate contacting the light source 10 and a heat dissipation fin protruding from the contact plate.

The light source device 1 may include the beam reducer for allowing beams emitted from the light source 10 to be incident into the condensing member 12 by reducing the beam widths of the beams.

The beam reducer 11 may allow incident beams having a constant beam width and linearity to be emitted by constantly reducing only the beam width and maintaining the linearity.

The beam reducer 11 may include a first reducer lens 111 for reducing the beam widths of beams emitted from the light source 10 while being transmitted therethrough, and a second reducer lens 112 spaced apart from the first reducer lens 111, the second reducer lens 112 reducing the beam widths of beams emitted from the first reducer lens 111 while being transmitted therethrough.

The first reducer lens 111 and the second reducer lens 112 may be spaced apart from each other with air interposed therebetween.

The first reducer lens 111 may be located between the light source 10 and the second reducer lens 112. The second reducer lens 112 may be located between the first reducer lens 111 and the condensing member 12.

The optical axis of the first reducer lens 111 and the optical axis of the second reducer lens 112 may be equal to each other.

Since the beams width of the beams are primarily reduced by the first reducer lens 111, the second reducer lens 112 may be formed smaller than the first reducer lens 111 so as to increase the utilization of spaces therearound.

The beams incident into the beam reducer 11 described above may be emitted in a state in which their beam widths are reduced while maintaining their linearity is maintained as it is.

When the light source device 1 includes the beam reducer 11, the beams emitted from the light source 10 may be incident into the beam reducer 11, emitted toward the condensing member 12 in a state in which their beam widths are reduced by the beam reducer 11, and then incident into the condensing member 12.

On the other hand, when the light source device 1 does not include the beam reducer 11, the beams emitted from the light source 10 may be incident into the condensing member 12. Hereinafter, implementations in which the beam reducer 11 is included in the light source device 1 will be described. However, implementations are not limited thereto and may include, for example, the beam reducer 11 not being included in the light source device 1.

The light source device 1 may include the condensing member 12 for condensing beams. The condensing member 12 may condense incident beams to be emitted, so that the beams are condensed to be incident as one point into the reflective fluorescent body 4 which will be described later.

The condensing member 12 may be an auxiliary lens for condensing beams.

The beams emitted from the beam reducer 11 are incident into the condensing member 12 and then condensed by the condensing member 12 to be emitted toward the reflecting member 13.

Preferably, the beam widths of the beams condensed by the condensing member 12 are gradually reduced until the beams reach the reflective fluorescent body 4, and the beams are incident as one point into the reflective fluorescent body 4.

The light source device 1 may include the reflecting member 13 for reflecting beams to change the beam paths of the beams.

The reflecting member 13 may be disposed such that the incident angles of incident beams are 45 degrees, thereby vertically changing the beam paths of the incident beams.

As the reflecting member 13 is disposed, the beam emission direction or disposition of the light source 10 may be changed, so that the lighting device may be made compact.

The beams emitted toward the reflecting member 13 from the condensing member 12 are reflected by the reflecting member 13 such that the beam paths of the beams may be changed. Then, the beams are reflected to the prism 2. More specifically, the beams are reflected to the second surface 22 of the prism 2.

When the light source device 1 includes the reflecting member 13, the beams path of the beams emitted from the condensing member 12 may be changed by the reflecting member 12 such that the beams are reflected to the prism 2. In this case, the light source 10 may emit the beams in a direction parallel to the optical axis X of the main lens 3.

On the other hand, when the light source device 1 does not include the reflecting member 13, the beams emitted from the condensing member 12 may be emitted toward the second surface 22 of the prism 2.

The light source device 1 may be implemented such that the disposition order of the beam reducer 11, the condensing member 12, and the reflecting member 13 are arranged in any suitable order.

The main lens 3 may be formed larger than the reflective fluorescent body 4 and the prism 2. The main lens 3 may protect the reflective fluorescent body 4 and the prism 2 at the front of the reflective fluorescent body 4 and the prism 2.

The main lens 3 may include a front surface 31 and a rear surface 32. The main lens 3 may further include a circumferential surface 33 depending on a shape of the main lens 3.

The front of the main lens 3 may refer to the front of the front surface 31 of the main lens 3. The rear of the main lens 3 may refer to the rear of the rear surface 32 of the main lens 3.

In some implementations, the front surface 31 of the main lens 3 may be a curved surface, and the rear surface 32 of the main lens 3 may be a flat surface.

If the rear surface 32 of the main lens 3 is a flat surface, the inside of the rear surface 32 of the main lens 3 is not empty, and hence optical loss occurring in an air space is reduced, thereby relatively increasing optical power. Also, the condensing effect of the main lens 3 is sufficient, and hence the number of projection lenses 5 may be decreased.

If the rear surface 32 of the main lens 3 is a flat surface, the main lens 3 may be more easily manufactured due to excellent machinability, and manufacturing cost may be reduced. Also, the size of the main lens 3 is reduced, and the number of projection lens 5 is decreased, so that the lighting device may be made compact.

The main lens 3 may have an optical axis X. Here, the optical axis of the main lens 3 may be a rotational symmetric axis or a central axis. The optical axis of the main lens 3 may mean a straight line passing through the center of the front surface 31 of the main lens 3 and the center of the rear surface 32 of the main lens 3.

The lighting device may further include a projection lens 5 disposed at the front of the main lens 3 so as to condense beams emitted from the front surface 31 of the main lens 3.

The projection lens 5 may be formed larger than the main lens 3.

The optical axis of the projection lens 5 may correspond to the optical axis X of the main lens 3.

The projection lens 5 may include a front surface 51, a rear surface 52, and a circumferential surface 53. The front surface 51 of the projection lens 5 may be a curved surface convex toward the front. The rear surface 52 of the projection lens 5 may be a flat surface.

The lighting device may further include a lens holder for supporting the main lens 3 and the projection lens 5.

The reflective fluorescent body 4 may be disposed at the rear of the prism 2. The reflective fluorescent body 4 may convert the wavelengths of beams reflected by the prism 2, thereby reflecting the beams to the prism 2. More specifically, the reflective fluorescent body 4 may convert the wavelengths of beams that are reflected on the third surface 23 of the prism 2, transmitted through the first surface of the prism 2, and then incident into the reflective fluorescent body 4. The reflective fluorescent body 4 may reflect the beams having the converted wavelengths to the first surface 21 of the prism 2.

When the wavelengths of beams are converted, heat may be generated from the reflective fluorescent body 4, and therefore, the reflective fluorescent body 4 is preferably disposed to be spaced apart from the prism 2. The reflective fluorescent body 4 may be disposed to be spaced apart from the first surface 21 of the prism 2 at the rear of the prism 2.

The reflective fluorescent body 4 may be disposed at the rear of the prism 2.

The reflective fluorescent body 4 is disposed to face the first surface 21 of the prism 2, and may reflect beams toward the first surface 21 of the prism 2.

In some implementations, the reflective fluorescent body 4 may be disposed on the optical axis X of the main lens 3. The reflective fluorescent body 4 may be disposed to be spaced apart from the first surface 21 of the prism 2.

In some implementations, the reflective fluorescent body 4 may be disposed to be eccentric with respect to the optical axis X of the main lens 3. However, in such a scenario, a region in the main lens 3 through which beams reflected by the reflective fluorescent body 4 are transmitted may be smaller than a corresponding region in the main lens 3 through which beams reflected by the reflective fluorescent body 4 are transmitted in a scenario where the reflective fluorescent body 4 is disposed on the optical axis X of the main lens 3. As such, an eccentric alignment may reduce the efficiency of the lighting device. In some implementations, the reflective fluorescent body 4 is therefore preferably disposed on the optical axis X of the main lens 3.

In some implementations, the reflective fluorescent body 4 may include a reflecting part for reflecting beams and a wavelength conversion layer for converting the wavelengths of beams.

The wavelength conversion layer may face the first surface 21 of the prism 2, and the reflecting part may be disposed at the rear of the wavelength conversion layer.

The wavelength conversion layer may be configured as a wavelength conversion film, and may include opto-ceramic. The wavelength conversion layer may convert the wavelengths of beams reflected on the third surface 23 of the prism 2 in a state in which the wavelength conversion layer is located at the front of the reflecting part.

In some implementations, the wavelength conversion layer may be a wavelength conversion film for converting blue-based incident beams into yellow-based beams. As an example, the wavelength conversion layer may include yellow opto-ceramic. In general, the wavelength conversion layer may be configured to perform wavelength conversion from any suitable wavelength of light generated by a light source into a different suitable wavelength.

The reflecting part may include a plate and a reflective coating layer coated on an outer surface of the plate. The plate may be made of metal.

The reflecting part may support the wavelength conversion layer, and beams transmitted through the wavelength conversion layer may be reflected toward the first surface 21 of the prism 2 by the reflecting part.

If blue-based beams are reflected to the reflective fluorescent body 4 by the third surface 23 of the prism 2, some of the blue-based beams are surface-reflected on a surface of the wavelength conversion layer, and beams incident into the wavelength conversion layer among the blue-based beams may be excited inside the wavelength conversion layer. The wavelengths of some of the blue-based beams may be converted into those of yellow-based beams, and the wavelengths of some of the blue-based beams may not be converted. The blue-based beams of which wavelengths are not converted and the yellow-based beams of which wavelengths are converted may be reflected forward the wavelength conversion layer by the reflecting part. The proportion in which the wavelengths of blue-based beams are converted into those of yellow-based beams inside the wavelength conversion layer may be changed depending on a proportion in which YAG is included in the wavelength conversion layer.

The blue-based and yellow-based beams emitted forward the wavelength conversion layer may be mixed together, and white-based beams are emitted forward the reflective fluorescent body 4. The white-based beams may be transmitted through the prism 2 and the main lens 3 and then emitted toward the front of the main lens 3.

In this case, unlike the laser beams having a constant beam width and linearity, the white-based beams emitted forward from the reflective fluorescent body 4 radially spread, and therefore, the prism 2 disposed at the front of the reflective fluorescent body 4, the main lens disposed at the front of the prism 2, and the projection lens 5 disposed at the front of the main lens 3 may function to condense the radially spreading white-based beams.

The distance d between the reflective fluorescent body and the prism 2 may determine a front-rear width of the lighting device.

If the distance d between the reflective fluorescent body 4 and the prism 2 is excessively long, the front-rear width of the lighting device is lengthened, and the optical efficiency of the lighting device is deteriorated. If the distance d between the reflective fluorescent body 4 and the prism 2 is excessively short, the prism 2 may be damaged due to heat generated from the reflective fluorescent body 4.

Therefore, the reflective fluorescent body 4 is preferably disposed close to the prism 2 within a range in which the damage of the prism 2 due to the heat may be mitigated.

In some implementations, a heat dissipation member 42 for helping heat dissipation of the reflective fluorescent body 4 may be disposed at the reflective fluorescent body 4. The heat dissipation member 42 may include a contact plate 43 contacting the reflective fluorescent body 4 and a heat dissipation fin 44 protruding from the contact plate 43.

In the reflective fluorescent body 4 according to this implementation, both a surface into which beams are incident and a surface from which the beams are emitted are the same as a front surface. In such implementations, the contact plate 43 may be attached so to surface-contact a rear surface of the reflective fluorescent body 4. As a result, the contact area between the contact plate 43 and the reflective fluorescent body is made wide, and thus heat dissipation may be effectively performed.

By contrast, in the case of a transmissive fluorescent body, one surface into which beams are incident is different from the other surface from which the beams are emitted. Therefore, in such scenarios, the heat dissipation member is disposed at a side or edge of the transmissive fluorescent body, and heat dissipation may not effectively be performed because the contact area between the heat dissipation member and the transmissive fluorescent body is narrow. As such, it may be preferable in some implementations to configure the reflective fluorescent body so that both a surface into which beams are incident and a surface from which the beams are emitted are the same as a front surface.

Figure 3:
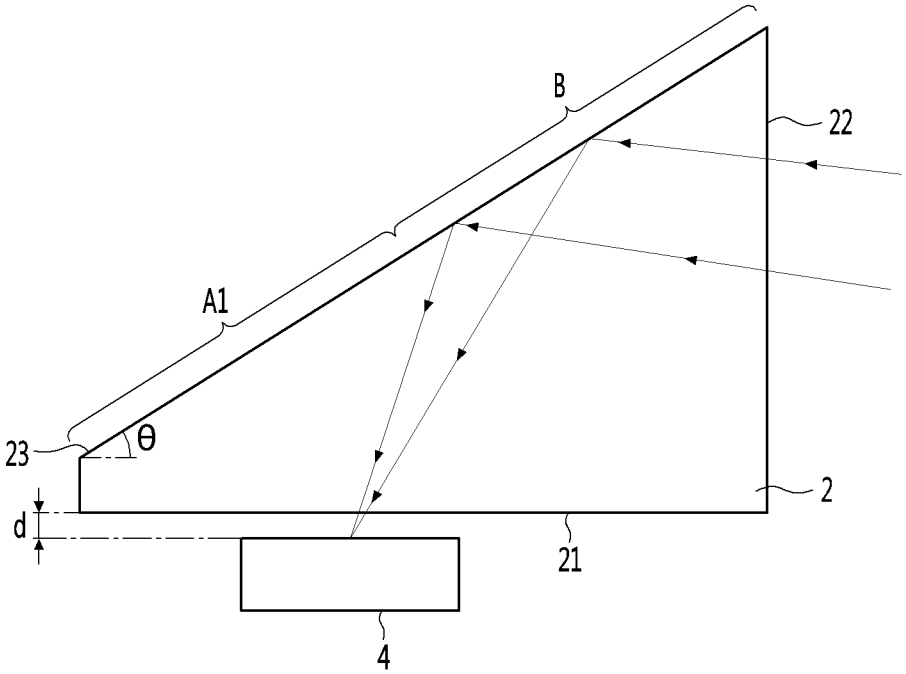
FIG. 3 is a diagram illustrating an example of a shape of a prism and beam paths of beams emitted from a light source device to be incident into the prism according to a first implementation.
Figure 4:
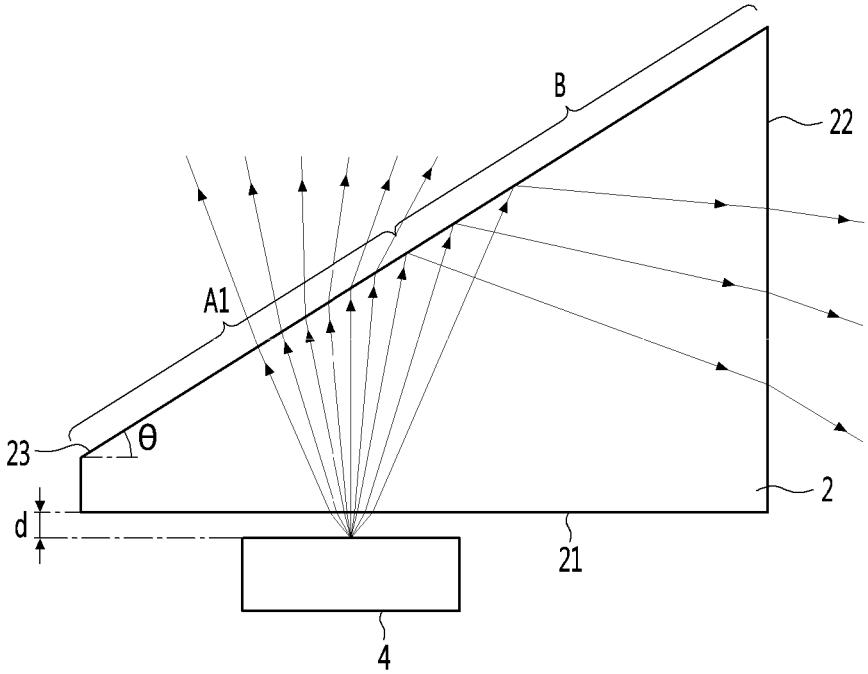
FIG. 4 is a diagram illustrating an example of a shape of the prism and beam paths of some of beams reflected by a reflective fluorescent body to the prism according to the first implementation.

FIG. 3 is a schematic view showing a shape of a prism 2 and beam paths of beams emitted from the light source device 1 to be incident into the prism according to a first implementation. FIG. 4 is a schematic view showing the shape of the prism 2 and beam paths of some of beams reflected by the reflective fluorescent body 4 to the prism 2 according to the first implementation.

The prism 2 may be configured to reflect beams emitted from the condensing member 12 to the reflective fluorescent body 4.

The prism 2 may be located between the main lens 3 and the reflective fluorescent body 4. The prism 2 may reflect beams emitted from the light source device 1 to the reflective fluorescent body 4 by using internal reflection on a third surface 23 of prism 2. The reflective fluorescent body 4 may perform wavelength conversion on the beams and the resulting wavelength-converted beams may then be reflected by the reflective fluorescent body 4 and transmitted back through a first surface 21 and the third surface 23 of prism 2 and then incident through the rear surface 32 of the main lens 3. As such, the prism 2 may be located between the rear surface 32 of the main lens 3 and the reflective fluorescent body 4.

In some implementations, the prism 2 may be disposed on the optical axis X of the main lens 3. Such an alignment may increase the region of the main lens 3 through which light passes from the prism 2.

In addition, the prism 2 may be disposed proximal to the main lens 3 so as to increase optical efficiency. As the distance between the prism 2 and the main lens 3 becomes distant, the quantity of condensed beams is reduced, and hence the optical efficiency may be deteriorated. Therefore, in some implementations, the prism 2 may contact the main lens 3.

In some implementations, the prism 2 may be formed smaller than the main lens 3. As such, the lighting device may be formed in a more compact arrangement.

The prism 2 may include the first surface 21 facing the reflective fluorescent body 4, a second surface 22 into which beams are incident, and the third surface 23 formed to make a predetermined acute angle with the first surface 21.

Incident angles of beams incident through the second surface 22 of the prism 2 with respect to the third surface 23 of the prism 2 may be greater than a critical angle of the prism 2.

According to an exemplary implementation, beams emitted from the light source device 1 may be incident through the second surface 22 of the prism 2. The beams incident through the second surface 22 may be transmitted through the prism 2 and then reflected on the third surface 23.

The beams reflected on the third surface 23 may be transmitted through the first surface 21 and then incident into the reflective fluorescent body 4, which performs wavelength conversion. Beams having converted wavelengths may be reflected by the reflective fluorescent body 4 to be incident through the first surface 21 and transmitted through the prism 2.

In some implementations, the second surface 22 may be at right angles to the first surface 21, may make a predetermined obtuse angle with the first surface 21, or may make a predetermined acute angle with the first surface 21. The particular angle may be arranged depending on a design of the prism 2 and is not limited to any particular angle. Hereinafter, a case where the second surface 22 and the first surface 21 are at right angles to each other will be described as an example.

As shown in FIG. 3, beams emitted from the light source device 1 may be obliquely incident through the second surface 22. Alternatively, the second surface 22 may be at right angles to the direction in which the beams are incident into the prism 2. For example, the beams emitted from the light source device 1 may be vertically incident through the second surface 22.

Referring to FIG. 3, beams incident through the second surface 22 may be reflected on the third surface 23. In this case, the reflection occurring on the third surface 23 may be total reflection. To this end, the incident angles of the beams incident into the prism 2 through the second surface 22 with respect to the third surface 23 may be greater than the critical angle of the prism 2.

When beams pass through a material having a high refractive index and into a material having a low refractive index, the beams are not transmitted through a boundary surface between the two materials at angles equal to or greater than a specific incident angle of the beams with respect to the boundary surface. Here, the specific incident angle is referred to as a critical angle.

The critical angle is determined by a refractive index of the inside of the boundary surface and a refractive index of the outside of the boundary surface. According to the implementation, when beams are incident through the third surface 23, the outside of the third surface 23 is air and the inside of the third surface 23 is the prism 2. Since the refractive index of the air is 1, the critical angle is determined based on a refractive index of a material of the prism 2.

Total reflection occurs on the third surface 23 only when the incident angles of beams incident through the second surface 22 with the third surface 23 is greater than the critical angle of the prism 2. In this case, the critical angle based on the material of the prism 2 is constant, and hence the occurrence of the total reflection may be determined based on a predetermined angle θ made by the first surface 21 and the third surface 23.

As the angle θ made by the first surface 21 and the third surface 23 becomes smaller, the incident angles of the beams through the second surface 22 with respect to the third surface 23 become larger, and the angle θ made by the first surface 21 and the third surface 23 is to be sufficiently small such that the incident angles of the beams through the second surface 22 with respect to the third surface 23 are greater than the critical angle of the prism 2. Therefore, the angle θ made by the first surface 21 and the third surface 23 may be a predetermined acute angle.

The third surface 23 may be formed to be connected to the first surface 21. The third surface 23 may make a predetermined angle θ with the first surface 21.

As shown in the shape of the prism 2 of FIG. 3, the third surface 23 may be formed to be spaced apart from the first surface 21. The third surface 23 may make a predetermined angle θ with the first surface 21. In this case, a surface connecting the third surface 23 and the first surface 21 to each other may be parallel to the second surface 22.

Although one surface and the other surface are spaced apart from each other, the angle between the two surfaces may be defined.

The length of the prism 2 is shortened by the shape of the prism 2. For example, the above-described shape of the prism 2 may result in the length of the prism 2 being shortened, so that the lighting device may be made compact.

The beam paths of beams are changed by the total reflection in the prism 2, and therefore, a separate reflecting part may not be provided. Accordingly, the number of optical devices required in the lighting device is decreased, so as to provide a compact lighting device.

Referring to FIG. 3, beams of which beam paths are changed by the total reflection on the third surface 23 may be transmitted through the first surface 21 and then incident into the reflective fluorescent body 4 from the prism 2. In this case, the beams may be refracted at the first surface 21.

The wavelengths of the beams incident into the reflective fluorescent body 4 may be converted to be reflected to the first surface 21 of the prism 2. Unlike the blue-based laser beams having a constant beam width and linearity, the beams having the converted wavelengths may be white-based beams radially spreading in the reflective fluorescent body 4.

Referring to FIG. 4, the beams having the converted wavelengths are reflected toward the first surface 21 from the reflective fluorescent body 4 and again refracted at the first surface 21 to be incident into the prism 2. The beams may reach the third surface 23 and are then either transmitted or reflected through the third surface 23, depending on the angle of incidence on the third surface relative to the critical angle.

More specifically, the beams of which wavelengths are converted by the reflective fluorescent body 4 to be incident through the first surface 21 are radially spread, and hence the incident angles of beams incident on the third surface 23 may be different from each other.

Referring to FIG. 4, as beams on the third surface 23 become distant from the first surface 21, the incident angles of the beams with respect to the third surface 23 may become larger.

If the incident angles of beams into the first surface from the reflective fluorescent body 4 with respect to the third surface 23 are smaller than the critical angle of the prism 2, the beams may be transmitted through the third surface 23 and then emitted from the prism 2 to the main lens 3. A region in which beams are transmitted through the third surface 23 may be referred to as a first transmission region A1, as shown in FIG. 4.

The beams incident through the first surface 21 from the reflective fluorescent body 4 may be refracted while being transmitted through the first surface 21, and may be refracted while being transmitted through the third surface 23 in the first transmission region A1. Through these refractions, the prism 2 may have a condensing effect in the process in which the beams of which wavelengths are converted by the reflective fluorescent body 4 to be reflected by the reflective fluorescent body 4 are emitted to the main lens 3.

On the other hand, if the incident angles of beams into the first surface 21 from the reflective fluorescent body 4 with respect to the third surface 23 are greater than the critical angle of the prism 2, then total reflection occurs. In this scenario, the beams are not transmitted through the third surface 23 but instead may be reflected. A region in which beams are reflected on the third surface 23 may be referred to as a reflection region B, as shown in FIG. 4.

The third surface 23 may include the first transmission region A1 in which beams incident through the first surface 21 from the reflective fluorescent body 4 are transmitted through the third surface 23 and the refection region B in which beams incident through the first surface 21 from the reflective fluorescent body 4 are reflected on the third surface 23. According to optical principles, a region in which beams that are transmitted through the second surface 22 and then incident into the prism 2 are totally reflected toward the reflective fluorescent body 4 on the third surface 23 may be a portion of the reflection region B.

The first transmission region A1 and the reflection region B may be changed depending on an angle θ made by the third surface 23 and the first surface 21, a critical angle of the prism 2 based on a refractive index of the prism 2, and the like. In addition, a portion at which beams do not reach may exist in the first transmission region A1 and the reflection region B. This may be similarly applied to a second transmission region A2 which will be described later.

Some of the beams of which wavelengths are converted by the reflective fluorescent body 4 may be transmitted through the third surface 23 in the first transmission region A1 and then incident into the main lens 3. The beams transmitted through the third surface 23 in the first transmission region A1 may be emitted to the front of the main lens 3. Therefore, if the reflection region B of the third surface 23 is excessively increased, the first transmission region A1 is decreased by an increase in the reflection region B, and hence the optical efficiency of the lighting device may be deteriorated.

Accordingly, the reflection region B of the third surface 23 is preferably decreased as small as possible. More specifically, when beams that emitted from the light source device 1 and then incident through the second surface 22 are totally reflected on the third surface 23 to be incident into the reflective fluorescent body 4, only a region in which the total reflection occurs becomes the reflection region B. The beams emitted from the light source device 1 may be blue-based laser beams having a narrow beam width and linearity, and therefore, a region in which total reflection occurs on the third surface 23 when the beams reach the third surface 23 may be very narrow.

In general, as the angle θ made by the third surface and the first surface 21 of the prism 2 is decreased, the first transmission region A1 may be widened, and the reflection region B may be narrowed. However, as described above, as beams are refracted in the first transmission region A1 of the third surface 23, the prism 2 may have the condensing effect. Thus, as the angle θ made by the third surface 23 and the first surface 21 of the prism 2 is increased, the condensing effect may be increased.

As an example, if the angle θ made by the third surface 23 and the first surface 21 of the prism 2 is excessively decreased, the condensing effect of the prism 2 is decreased, and the quantity of beams incident into the main lens 3 is decreased. Therefore, the optical efficiency of the lighting device may be deteriorated.

On the contrary, if the angle θ made by the third surface 23 and the first surface 21 of the prism 2 is excessively increased, the beams that are emitted from the light source device 1 and then incident through the second surface 22 may not be totally reflected on the third surface 23, or the beams of which wavelengths are converted by the reflective fluorescent body 4 to be reflected by the reflective fluorescent body 4 may be totally reflected without being transmitted through the third surface 23.

Therefore, in order to improve the entire optical efficiency of the lighting device, the angle θ made by the third surface 23 and the first surface 21 of the prism 2 is preferably determined such that both the conditions are properly satisfied.

According to the above-described configuration, a separate optical part for allowing beams to be incident into the reflective fluorescent body 4 is not necessary at the front of the main lens 3, and thus optical parts may be more easily disposed. Moreover, the main lens 3 and the projection lens 5 may be disposed close to each other, thereby improving the optical efficiency of the lighting device.

In addition, since reflection and transmission simultaneously occur in the prism 2, the number of required optical parts is decreased, thus providing a more compact light device. More specifically, beams incident through the second surface 22 of the prism 2 from the light source device 1 may be reflected to the reflective fluorescent body 4 on the third surface 23, and beams of which wavelengths are converted by the reflective fluorescent body 4 may be transmitted through the first surface 21 and the third surface 23 and then emitted to the main lens 3. As such, reflection and transmission may simultaneously occur in the prism 2.

Hereinafter, an operation of the present disclosure configured as described above will be described as follows.

Hereinafter, a case where the light source 10 emits blue-based beams, and the reflective fluorescent body 4 converts the wavelengths of the blue-based beams into those of yellow-based beams will be described as an example.

First, if the light source 10 included in the light source device is on, blue-based beams may be emitted from the light source 10. The beams may be incident into the beam reducer 11 such that the beam widths of the beams are reduced. The beams having the reduced beam widths may be incident into the condensing member 12.

The beams incident into the condensing member 12 may be condensed to be emitted toward the reflecting member 13.

The beams of which beam paths are changed by the reflecting member 13 may be reflected to the second surface 22 of the prism 2.

The beams incident through the second surface 22 of the prism 2 may be transmitted through the prism 2 and then totally reflected on the third surface 23 of the prism 2. The beams reflected on the third surface 23 such that their beam paths are changed may be transmitted through the first surface 21 and then incident into the reflective fluorescent body 4 from the prism 2.

The wavelengths of the beams incident into the reflective fluorescent body 4 are converted by the reflective fluorescent body 4. In the reflective fluorescent body 4, white-based beams may be reflected to the first surface 21 of the prism 2. The beams may be refracted while being incident through the first surface 21 of the prism 2.

Some of the beams incident through the first surface 21 of the prism 2 may be transmitted through the third surface 23 in the first transmission region A1, and some of the beams incident through the first surface 21 of the prism 2 may be reflected on the third surface 23 in the reflection region B. The reflected beams may be reflected to the second surface 22, and the transmitted beams may be incident through the rear surface 32 of the main lens 3.

The beams incident through the rear surface 32 of the main lens 3 may be condensed while being transmitted through the main lens 3. Such white-based beams may be transmitted through the front surface 31 of the main lens 3 and then incident into the projection lens 5 through the rear surface 52 of the projection lens 5.

The beams incident through the rear surface 52 of the projection lens 5 may be condensed by the projection lens 5 to be emitted in parallel to each other. The beams may be irradiated to the front of the vehicle.

Figure 5:
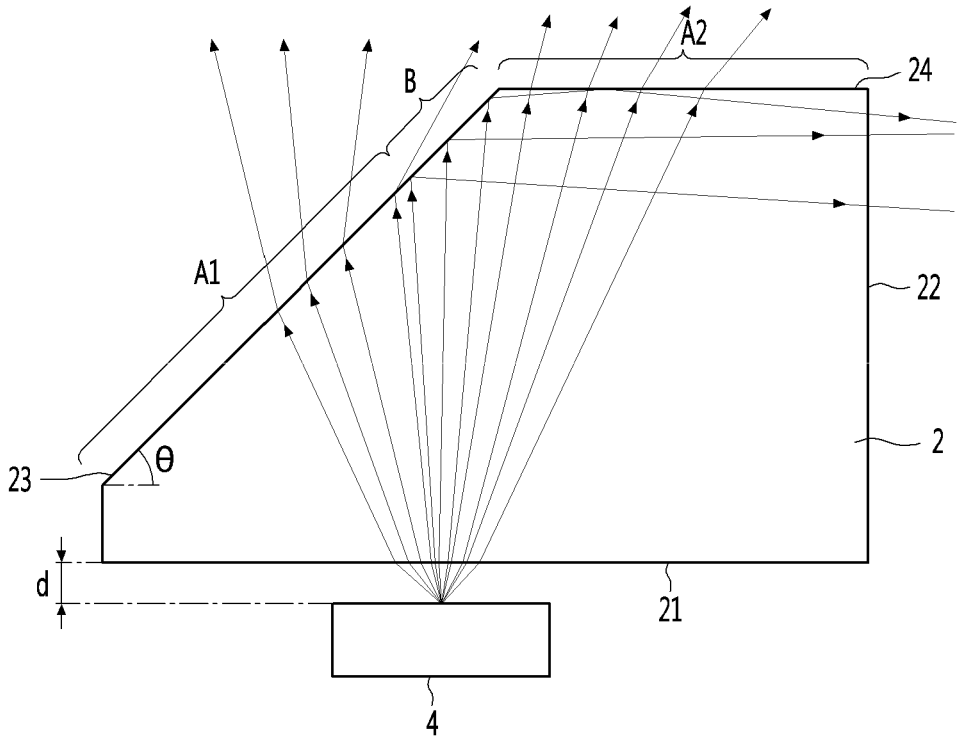
FIG. 5 is a diagram illustrating an example of a shape of a prism and beam paths of some of beams reflected by the reflective fluorescent body to the prism according to a second implementation.

FIG. 5 is a schematic view showing a shape of a prism and beam paths of some of beams reflected by the reflective fluorescent body 4 to the prism 2 according to a second implementation.

Hereinafter, detailed descriptions of components identical or similar to those of the aforementioned implementation will be omitted and their differences will be described.

In this implementation, the prism 2 may further include a fourth surface 24 connecting a third surface 23 and a second surface 22 to each other. The incident angles of beams reflected by the reflective fluorescent body 4 with respect to the fourth surface 24 may be smaller than a critical angle of the prism 2.

The third surface 23 of the prism 2 may include a first transmission region A1 in which beams are transmitted through the third surface 23 and a reflection region B in which beams are reflected on the third surface 23. In this case, the prism 2 may further include the fourth surface 24 so as to decrease the reflection region B.

The prism 2 according to this implementation may have a shape obtained by cutting an upper end of the prism 2 according to the first implementation, and a surface formed by cutting the upper end of the prism 2 may be the fourth surface 24. However, the prism 2 according to this implementation is not limited to the shape formed through the cutting, and other shapes of the prism 2 may be formed.

The fourth surface 24 may be parallel to a first surface 21, and the horizontal length of the fourth surface 24 may be shorter than that of the horizontal length of the first surface 21.

The third surface 23 may include the reflection region B in which beams are reflected to the reflective fluorescent body 4 and the first transmission region A1 in which beams reflected by the reflective fluorescent body 4 are transmitted through the third surface 23. The fourth surface 24 may include a second transmission region A2 in which the beams reflected by the reflective fluorescent body 4 are transmitted through the fourth surface 24.

As described above, only a region in which beams that are emitted from the light source device 1 and then incident through the second surface 22 of the prism 2 are reflected on the third surface 23 becomes the reflection region B, which is most preferable.

As the distance of the third surface 23 from the first surface 21 becomes distant, the incident angles of beams that are reflected by the reflective fluorescent body 4 and then incident through the first surface 21 with respect to the third surface 23 are increased. Therefore, an upper end of the region in which the beams that emitted from the light source device 1 and then incident through the second surface 22 of the prism 2 are reflected on the third surface 23 may be cut, thereby forming the fourth surface 24.

As compared with the third surface, the angle made by the fourth surface 24 and the first surface 21 is small, or the fourth surface 24 may be parallel to the first surface 21. Therefore, the incident angles of beams reflected by the reflective fluorescent body 4 with respect to the fourth surface 24 may be smaller than the critical angle of the prism 2. For example, the fourth surface 24 may be formed by cutting a portion of the upper end of the reflection region B in which beams reflected by the reflective fluorescent body 4 was previously reflected on the third surface 23. As such, the second transmission region A2 in which the beams are transmitted through the fourth surface 24 may be included in the fourth surface 24.

If the fourth surface 24 is formed by cutting the upper end of the reflection region B of the third surface 23, the reflection region B may be located along an outer surface of the prism 2 between the first transmission region A1 and the second transmission region A2.

The beams that are emitted from the light source device 1 and then incident through the second surface 22 may be blue-based laser beams having a narrow beam width and linearity. Therefore, the reflection region B in which the beams are reflected may be formed smaller than the first transmission region A1 and the second transmission region A2.

According to this implementation, the reflection region B may be reduced without decreasing the angle between the third surface 23 and the first surface 21, and the vertical height of the prism 2 may be decreased, thereby reducing optical loss inside the prism 2. Such configurations may improve the optical efficiency of the lighting device. Further, the lighting device may become compact.

Figure 6:
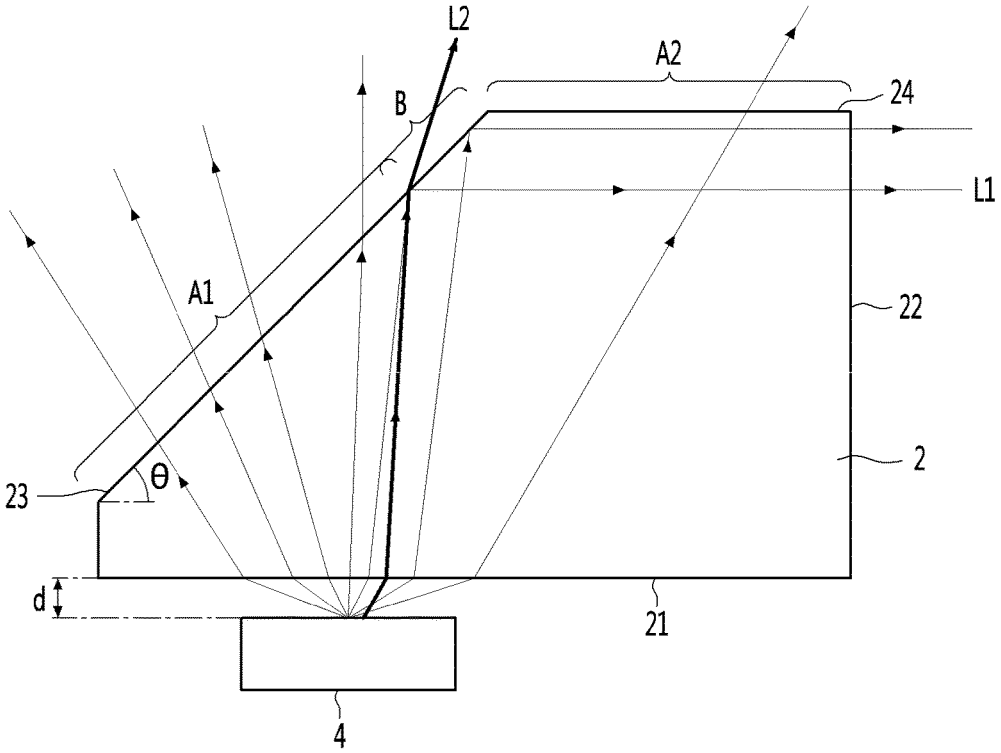
FIG. 6 is a diagram illustrating an example of a shape of a prism and beam paths of some of beams reflected by the reflective fluorescent body to the prism according to a third implementation.

FIG. 6 is a schematic view showing a shape of a prism and beam paths of some of beams reflected by the reflective fluorescent body 4 to the prism 2 according to a third implementation.

Hereinafter, detailed descriptions of components identical or similar to those of the aforementioned implementation will be omitted and their differences will be described. In this implementation, the prism 2 is different from that of the second implementation in that a portion of a reflection region B overlaps with a portion of a first transmission region A1, and therefore, this will be mainly described.

As described above, the reflective fluorescent body 4 may include a reflecting part for reflecting beams and a wavelength conversion layer for converting the wavelengths of beams. The reflecting part may support the wavelength conversion layer, and beams transmitted through the wavelength conversion layer may be reflected toward a first surface 21 of the prism 2 by the reflecting part.

In this case, beams incident into the wavelength conversion layer of the reflective fluorescent body 4 may be reflected by the reflecting part while radially spreading and then emitted from the reflective fluorescent body 4 while again radially spreading. That is, although the beams are incident as one point into the reflective fluorescent body 4, if the wavelength conversion layer is thick, the wavelengths of the beams such that the beams radially spread inside the wavelength conversion layer. Therefore, the region in which the beams having the converted wavelengths are emitted from the reflective fluorescent body 4 may be wider than the region in which the beams are incident into the reflective fluorescent body 4.

The beams incident into the reflective fluorescent body 4 may be incident into a central portion of the reflective fluorescent body 4. The beams of which wavelengths are converted by the reflective fluorescent body 4 to be emitted from the reflective fluorescent body 4 may be emitted in a region reaching from the central portion to the peripheral portion of the reflective fluorescent body 4.

Therefore, the incident angles of beams, with respect to a third surface 23, which are reflected by the reflective fluorescent body 4 and incident through the first surface 21 to reach a third surface 23, may be different from each other depending on positions at which the beams are emitted from the reflective fluorescent body 4 when they reach a specific position on the third surface 23.

More specifically, as points at which the beams are emitted from the reflective fluorescent body 4 reach from the central portion to the peripheral portion of the reflective fluorescent body 4, the incident angles of the beams emitted from the reflective fluorescent body 4 with respect to the third surface 23 when they reach the third surface 23 may become smaller.

Referring to FIG. 6, beams that reach a specific position of the third surface 23 may be named as a first beam L1 and a second beam L2, respectively. Here, the first beam L1 may be a beam emitted from the central portion of the reflective fluorescent body 4, and the second beam L2 may be a beam emitted from the peripheral portion of the reflective fluorescent body 4. The first beam L1 and the second beam L2 may reach at the same position of the third surface 23. The first beam L1 may be reflected on the third surface 23, and the second beam L2 may be transmitted through the third surface 23 while being refracted at the third surface 23. As such, the incident angle of the first beam L1 with respect to the third surface 23 may be greater than a critical angle of the prism 2, and the incident angle of the second beam L2 with respect to the third surface 23 may be smaller than the critical angle of the prism 2.

When the incident angle of one beam, with respect to the third surface 23, which reaches a specific region of the third surface 23, is greater than the critical angle of the prism 2, and the incident angle of another beam, with respect to the third surface 23, which reaches the same region of the third surface 23, is smaller than the critical angle of the prism 2, reflection and transmission may simultaneously occur in the corresponding region of the third surface 23. For example, a portion of the reflection region B in which beams are reflected on the third surface 23 may overlap with a portion of the first transmission region A1.

Figure 7:
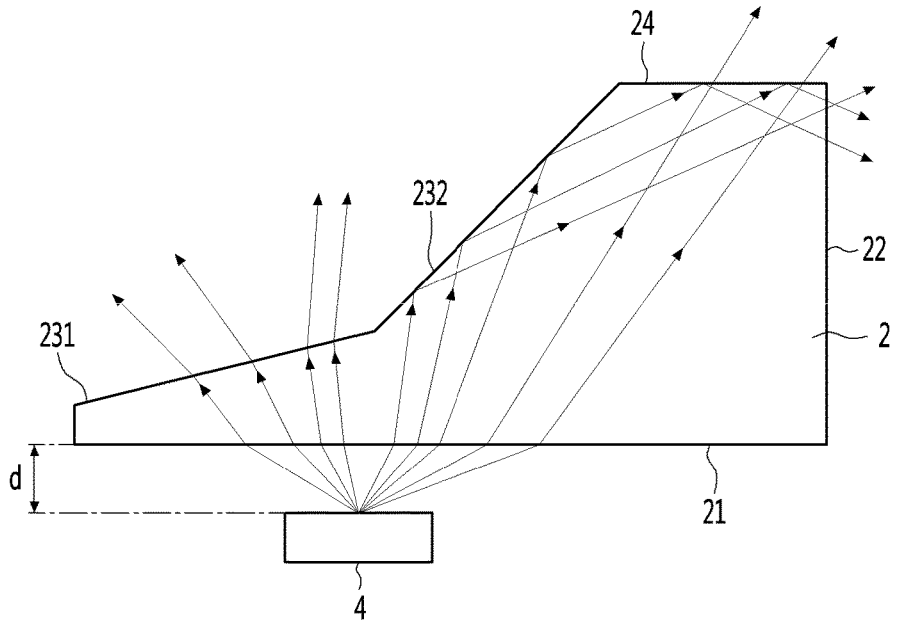
FIG. 7 is a diagram illustrating an example of a shape of a prism and beam paths of some of beams reflected by the reflective fluorescent body to the prism according to a fourth implementation.

FIG. 7 is a schematic view showing a shape of a prism and beam paths of some of beams reflected by the reflective fluorescent body 4 to the prism 2 according to a fourth implementation.

Hereinafter, detailed descriptions of components identical or similar to those of the aforementioned implementation will be omitted and their differences will be described.

According to this implementation, a third surface 23 of the prism 2 may include a reflection surface 232 for allowing beams to be reflected to the reflective fluorescent body 4, and a transmission surface 231 for allowing beams reflected by the reflective fluorescent body 4 to be transmitted therethrough.

The reflection surface 232 may correspond to a reflection region B, and the transmission surface 231 may correspond to a first transmission region A1.

The angle made by the transmission surface 231 and a first surface 21 may be smaller than that made by the reflection surface 232 and the first surface 21. As such, the inclination angle of the transmission surface 231 may be smaller than that of the reflection surface 232.

The incident angles of beams, with respect to the transmission surface 231, which are reflected by the reflective fluorescent body 4 to reach the transmission surface 231, may be smaller than a critical angle of the prism 2. On the other hand, the incident angles of beams, with respect to the reflection surface 232, which are reflected by the reflective fluorescent body 4 to reach the reflection surface 232, may be smaller than the critical angle of the prism 2.

According to this implementation, since the inclination angles of the transmission surface 231 and the reflection surface 232 are different from each other, the region in which beams are transmitted through the third surface 23 and the region in which beams are reflected on the third surface 23 may be distinguished from each other.

Figure 8:
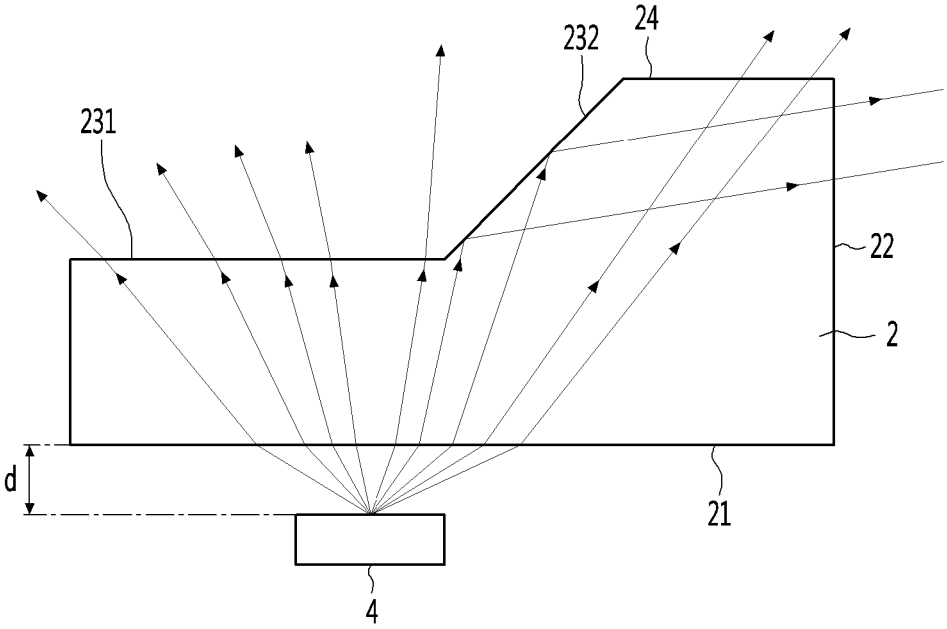
FIG. 8 is a diagram illustrating an example of a shape of a prism and beam paths of some of beams reflected by the reflective fluorescent body to the prism according to a fifth implementation.

FIG. 8 is a schematic view showing a shape of a prism and beam paths of some of beams reflected by the reflective fluorescent body 4 to the prism 2 according to a fifth implementation.

Hereinafter, detailed descriptions of components identical or similar to those of the aforementioned implementation will be omitted and their differences will be described. The prism 2 according to this implementation is different from the prism 2 according to the fourth implementation in that a transmission surface 231 is parallel to a first surface 21, and therefore, this will be mainly described.

According to this implementation, a third surface 23 of the prism 2 may include a reflection surface 232 for allowing beams to be reflected to the reflective fluorescent body 4, and the transmission surface 231 extending from the reflection surface 232, the transmission surface 231 being parallel to the first surface 21.

The transmission surface 231 may be spaced apart from the first surface 21, and a surface connecting the transmission surface 231 and the first surface 21 to each other may be parallel to a second surface 22.

Since the transmission surface 231 is parallel to the first surface 21, the incident angles of beams, with respect to the transmission surface 231, which are reflected by the reflective fluorescent body 4 to reach the transmission surface 231, may be smaller than a critical angle of the prism 2. Thus, beams of which wavelengths are converted by the reflective fluorescent body 4 to be reflected by the reflective fluorescent body 4 may be transmitted through the transmission surface 231.

Although implementations have been described with reference to a number of illustrative implementations thereof, it should be understood that numerous other modifications and implementations may be devised by those skilled in the art that will fall within the spirit and scope of the principles of this disclosure.

Further, the beam paths shown in the drawings are provided to help the description without limiting the spirit or scope of the present disclosure, and may be changed within the scope of the disclosure without departing from the essential features of the disclosure.

Accordingly, the aforementioned implementations should be construed not to limit the technical spirit of the present disclosure but to be provided for illustrative purposes. The scope of the present disclosure should not be limited to the aforementioned implementations but defined by appended claims. The technical spirit within the scope substantially identical with the scope of the present disclosure will be considered to fall in the scope of the present disclosure defined by the appended claims.

What is claimed is:

1. A lighting device for a vehicle, comprising:
- a light source device;
- a main lens;
- a reflective fluorescent body configured to reflect and convert wavelengths of incident beams;
- a heat radiating member configured to dissipate heat from the reflective fluorescent body; and
- a prism arranged between the main lens and the reflective fluorescent body, the prism configured to:
  - reflect beams emitted from the light source device to be incident on the reflective fluorescent body; and
  - transmit, through the prism and to the main lens, beams reflected from the reflective fluorescent body,
- wherein the prism comprises:
  - a first surface facing the reflective fluorescent body;
  - a second surface through which beams are incident; and
  - a third surface forming an acute angle with the first surface, and
  - wherein the prism is configured such that the beams incident through the second surface of the prism form angles of incidence, with respect to the third surface of the prism, that are greater than a critical angle of the prism,
  - wherein the reflective fluorescent body comprises:
    - a reflecting part configured to reflect beams; and
    - a wavelength conversion layer configured to convert wavelengths of the beams,
    - wherein the wavelength conversion layer is disposed to face the first surface of the prism and is configured to convert the wavelengths of the beams reflected on the third surface of the prism, and
    - wherein the reflecting part is disposed at a rear of the wavelength conversion layer.

2. The lighting device according to claim 1, wherein the light source device comprises a light source and a condensing member configured to condense beams emitted from the light source.

3. The lighting device according to claim 2, wherein the condensing member comprises an auxiliary lens configured to condense beams.

4. The lighting device according to claim 2, wherein the light source device further comprises a reflecting member configured to redirect paths of beams emitted from the condensing member of the light source device to be incident into the prism.

5. The lighting device according to claim 4, wherein the light source of the light source device is configured to emit beams in a direction parallel to an optical axis of the main lens.

6. The lighting device according to claim 1, wherein the reflective fluorescent body is disposed on an optical axis of the main lens.

7. The lighting device according to claim 1, wherein the prism is configured such that the second surface of the prism is formed at a right angle relative to a direction in which beams are incident into the prism.

8. The lighting device according to claim 1, wherein the prism is configured such that the second surface of the prism forms a right angle with the first surface of the prism.

9. The lighting device according to claim 1, wherein the prism is arranged such that the first surface of the prism is spaced apart from the reflective fluorescent body.

10. The lighting device according to claim 1, wherein the prism and the main lens are arranged such that the prism contacts the main lens.

11. The lighting device according to claim 1, wherein the prism further comprises a fourth surface extending between the third surface and the second surface, wherein the reflective fluorescent body and the prism are arranged such that angles of incidence of the beams reflected by the reflective fluorescent body into the prism with respect to the fourth surface are smaller than the critical angle of the prism.

12. The lighting device according to claim 11, wherein the prism is configured such that:

the fourth surface of the prism is parallel to the first surface of the prism, and a horizontal length of the fourth surface of the prism is smaller than a horizontal length of the first surface of the prism.

13. The lighting device according to claim 11, wherein the third surface of the prism comprises:

a reflection region in which beams are reflected by the third surface to the reflective fluorescent body; and a first transmission region in which the beams reflected by the reflective fluorescent body are transmitted through the third surface, wherein the fourth surface of the prism comprises a second transmission region in which the beams reflected by the reflective fluorescent body are transmitted through the fourth surface, and wherein the reflection region of the third surface of the prism is arranged along an outer surface of the prism between the first transmission region of the third surface and the second transmission region of the fourth surface.

14. The lighting device according to claim 11, wherein the third surface of the prism comprises:

a reflection region in which beams are reflected by the third surface to the reflective fluorescent body; and a first transmission region in which beams reflected by the reflective fluorescent body are transmitted through the third surface, wherein the fourth surface of the prism comprises a second transmission region in which the beams reflected by the reflective fluorescent body are transmitted through the fourth surface, wherein the third surface is configured such that at least a portion of the reflection region of the third surface overlaps with at least a portion of the first transmission region of the third surface.

15. The lighting device according to claim 13, wherein the reflection region of the third surface has a size that is smaller than a size of the first transmission region of the third surface and smaller than a size of the second transmission region of the fourth surface.

16. The lighting device according to claim 1, wherein the third surface of the prism comprises:

a reflection surface configured to reflect beams to the reflective fluorescent body; and a transmission surface forming a smaller inclination angle than the reflection surface, the transmission surface configured to transmit therethrough the beams that are reflected by the reflective fluorescent body.

17. The lighting device according to claim 1, wherein the third surface of the prism comprises:

a reflection surface configured to reflect beams to the reflective fluorescent body; and a transmission surface extending from the reflection surface and parallel to the first surface of the prism.

18. The lighting device according to claim 1, wherein the prism and the main lens are configured such that a size of the prism is smaller than a size of the main lens.

19. The lighting device according to claim 1, wherein the second surface and the third surface of the prism are configured such that the beams incident through the second surface and having angles of incidence, with respect to the third surface, exceeding the critical angle of the prism undergo total internal reflection at the third surface and are reflected to the reflective fluorescent body.

20. The lighting device according to claim 1, wherein the second surface and the third surface of the prism are configured such that the critical angle of the prism is a threshold angle of incidence on a surface of the prism greater than which total internal reflection occurs.

* * * * *